US009964076B2

(12) United States Patent
De La Morena et al.

(10) Patent No.: US 9,964,076 B2
(45) Date of Patent: May 8, 2018

(54) COOLING SYSTEM FOR AN INTERNAL COMBUSTION ENGINE

(71) Applicant: GM GLOBAL TECHNOLOGY OPERATIONS LLC, Detroit, MI (US)

(72) Inventors: Joaquin De La Morena, Turin (IT); Cesare Maria Meano, Turin (IT)

(73) Assignee: GM GLOBAL TECHNOLOGY OPERATIONS LLC, Detroit ( * ) Notice: Subject to any disclaimer, the term of this patent is extended or adjusted under 35 U.S.C. 154(b) by 167 days.

(21) Appl. No.: 14/729,726

(22) Filed: Jun. 3, 2015

(65) Prior Publication Data

US 2015/0345432 A1 Dec. 3, 2015

(30) Foreign Application Priority Data

Jun. 3, 2014 (GB) ..... 1409838.8

(51) Int. Cl.

| | |
|---|---|
| ***F02M 26/24*** | (2016.01) |
| ***F02M 26/33*** | (2016.01) |
| ***F02M 25/07*** | (2006.01) |
| ***F01P 5/10*** | (2006.01) |
| ***F01P 3/18*** | (2006.01) |
| ***F01P 3/16*** | (2006.01) |
| ***F01P 7/14*** | (2006.01) |

(52) U.S. Cl.

CPC ..... *F02M 25/0738* (2013.01); *F01P 3/16* (2013.01); *F01P 3/18* (2013.01); *F01P 5/10* (2013.01); *F01P 7/14* (2013.01); *F02M 26/24* (2016.02); *F02M 26/33* (2016.02)

(58) Field of Classification Search

CPC ..... F02M 26/05; F02M 26/06; F02M 26/04; F02M 26/43; F02M 26/23; F02M 26/32; F02M 26/33; F02M 26/17; F02M 26/24; F02M 26/30; F02M 26/22; F02M 26/25; F02M 25/0738; F02D 41/0065; F02D 2041/0067; F02D 41/0047; F01P 5/10; F01P 3/18; F01P 3/16; F01P 7/14

USPC ..... 123/568.11–568.32

See application file for complete search history.

(56) References Cited

U.S. PATENT DOCUMENTS

| | | | | |
|---|---|---|---|---|
| 8,424,303 | B2 | 4/2013 | Kardos et al. | |
| 8,602,007 | B2 | 12/2013 | Wu | |
| 2012/0067332 | A1* | 3/2012 | Wu | F02B 29/0412 123/568.12 |
| 2014/0150450 | A1* | 6/2014 | Golin | F01N 13/1805 60/796 |

(Continued)

FOREIGN PATENT DOCUMENTS

WO 2008069743 A1 6/2008

OTHER PUBLICATIONS

Great Britain Patent Office, Great Britain Search Report for Great Britain Application No. 1409838.8, dated Nov. 20, 2014.

*Primary Examiner* — Sizo Vilakazi

(74) *Attorney, Agent, or Firm* — Lorenz & Kopf LLP

(57) ABSTRACT

A cooling system for an internal combustion engine is disclosed which includes a coolant pump for circulating a coolant in a coolant circuit and a radiator disposed in the coolant circuit. A charged-air cooler is disposed in the coolant circuit downstream of the radiator, and a long-route exhaust-gas-recirculation cooler disposed in the coolant circuit downstream of the charged-air cooler and upstream of the radiator.

8 Claims, 3 Drawing Sheets

(56) References Cited

U.S. PATENT DOCUMENTS

| | | | | |
|---|---|---|---|---|
| 2014/0251239 | A1* | 9/2014 | Richards | F02M 31/205 123/41.05 |
| 2015/0121847 | A1* | 5/2015 | Pursifull | F01N 5/02 60/274 |
| 2016/0040583 | A1* | 2/2016 | Vaughn | F01P 3/20 123/41.08 |
| 2016/0084142 | A1* | 3/2016 | Gooden | F01P 3/20 123/41.33 |
| 2016/0138878 | A1* | 5/2016 | Gopal | F01P 3/20 165/103 |

* cited by examiner

COOLING SYSTEM FOR AN INTERNAL COMBUSTION ENGINE

CROSS-REFERENCE TO RELATED APPLICATION

This application claims priority to Great Britain Patent Application No. 1409838.8, filed Jun. 3, 2014, which is incorporated herein by reference in its entirety.

TECHNICAL FIELD

The present disclosure pertains to a cooling system for an internal combustion engine, typically an internal combustion engine of a motor vehicle. More specifically, the present disclosure relates to a so-called "low-temperature" cooling system, which is conventionally used to reduce the temperature of the combustion air directed to the engine by means of a charged-air cooler.

BACKGROUND

It is known that an internal combustion engine, such a compression-ignition engine (e.g. Diesel) or a spark-ignition engine (e.g. gasoline), operates by cyclically igniting an air/fuel mixture inside the engine cylinders. The combustion of the air/fuel mixture generates hot exhaust gasses, whose expansion causes a reciprocating movement of the engine pistons that are coupled to rotate a crankshaft.

The heat generated by the fuel combustion is partly dissipated by a so called "high-temperature" cooling system, which includes a coolant pump that circulates a coolant, typically a mixture of water and antifreeze, through a plurality of cooling channels realized in the engine block and cylinder head. The coolant exiting from these channels is directed towards a "high-temperature" radiator, where the coolant exchanges the heat received from the engine with the air of the ambient environment, before returning in the coolant pump.

In order to enhance the engine power, the internal combustion engine may be further equipped with a turbocharger, which includes a compressor rotationally coupled to a turbine. The turbine is rotated by the exhaust gasses exiting from the engine cylinders and drives the compressor, which is arranged to increase the pressure of the combustion air directed into the engine cylinders.

Since the compression has the effect of increasing also the air temperature, the air exiting the compressor may be directed into a water-cooled charged-air cooler (WCAC), which is provided for reducing the air temperature before reaching the engine cylinders. To perform this function, the WCAC is usually disposed in a "low-temperature" cooling system, separated from the "high-temperature" cooling system provided for cooling the engine. The "low-temperature" cooling system includes an additional coolant pump that circulates a coolant, typically a mixture of water and antifreeze, through the WCAC first and then through a "low-temperature" radiator provided for reducing the coolant temperature before returning to the coolant pump.

The internal combustion engine may be further equipped with a "long-route" (LR) EGR system (also known as low pressure EGR system), which is provided for recirculating a portion of the exhaust gasses back into the engine cylinders, basically in order to reduce nitrogen oxides ($NO_x$) emissions.

The LR-EGR system usually includes an LR-EGR conduit that branches from an exhaust pipe downstream of the turbine of the turbocharger and leads the exhaust gasses into an intake pipe upstream of the compressor. The LR-EGR system further includes an LR-EGR cooler located in the LR-EGR conduit to reduce the temperature of the exhaust gasses before they reach the intake pipe, and an LR-EGR valve provided for regulating the amount of recirculated exhaust gasses.

The LR-EGR cooler is conventionally disposed in the "high-temperature" cooling system, so that the exhaust gasses flowing through the "long-route" EGR system are cooled by the same coolant that has been used to reduce the engine temperature. Due to this arrangement, the temperature of the coolant entering the LR-EGR cooler may normally be of 90° C. or more, which implies that the LR-EGR cooler needs to be chosen and/or dimensioned to have a good thermal efficiency for these relatively high coolant temperature values.

However, during the warm-up phase of the internal combustion engine, the temperature of the coolant in the "high-temperature" cooling system may be much lower, for example of about 20° C. or less. In these conditions, the efficiency of the LR-EGR cooler results extremely intensified and the exhaust gasses are thus subjected to an extremely severe cooling, which may cause the condensation of the vapor contained in the exhaust gasses into water droplets. When reaching the intake pipe, these water droplets are accelerated by the intake air stream and projected at high speed to collide with the wheel of the compressor.

To prevent the potential damages caused by these collisions, the LR-EGR system may include a bypass valve that, during the engine warm-up, deviates the exhaust gasses coming from the exhaust pipe into a secondary conduit that bypasses the LR-EGR cooler. However, this solution generally complicates and increases the cost of the LR-EGR system and may not guarantee the total absence of condensation. As an alternative, the LR-EGR valve may be controlled to minimize as much as possible the recirculation of the exhaust gasses during the engine warm-up phases. However, this solution represents an important limitation to the functionality of the LR-EGR system, which contributes to increase the pollutant emissions of the engine in those operating phases.

In addition, other objects, desirable features and characteristics will become apparent from the subsequent summary and detailed description, and the appended claims, taken in conjunction with the accompanying drawings and this background.

SUMMARY

Accordingly, the present disclosure provides a method and apparatus which solves or at least of positively reduces the above mentioned drawbacks linked with the water condensation inside the LR-EGR cooler in a relatively simple, rational and rather inexpensive solution. More particularly, an embodiment of the present disclosure provides a cooling system for an internal combustion engine, including a coolant pump for circulating a coolant in a coolant circuit, a radiator disposed in the coolant circuit, a charged-air cooler disposed in the coolant circuit downstream of the radiator, and a long-route exhaust-gas-recirculation cooler disposed in the coolant circuit downstream of the charged-air cooler and upstream of the radiator. As a matter of fact, this embodiment of the present disclosure provides for disposing the LR-EGR cooler in the "low-temperature" cooling system, so that the temperature of the coolant entering the LR-EGR cooler depends on the heat exchange inside the WCAC. In this way, the temperature of the coolant entering the LR-EGR cooler can be high enough to prevent condensation phenomena, but still lower than the temperature of the coolant in the "high-temperature" cooling system, thereby allowing the use of a LR-EGR cooler which is smaller than the conventional LR-EGR coolers, with the effect of improving packaging and reducing the costs.

According to an aspect of the present disclosure, the cooling system may further includes a cooler for a diesel-exhaust-fluid (DEF) injector disposed in the coolant circuit downstream of the charged-air cooler and upstream of the long-route exhaust-gas-recirculation cooler. The DEF injector is a known device used to inject a diesel exhaust fluid, typically urea ($CH_4N_2O$), into the exhaust pipe downstream of the turbine. The urea mixes with the exhaust gasses and, due to a thermo-hydrolysis process, is converted into ammonia ($NH_3$) which is adsorbed inside a selective catalytic reduction (SCR) catalyst disposed in the exhaust pipe downstream of the DEF injector. Inside the SCR catalyst, the ammonia acts as a gaseous reducing agent that prompts the reduction of the nitrogen oxides ($NO_x$) contained in the exhaust gasses into diatonic nitrogen ($N_2$) and water ($H_2O$). Since the DEF injector is exposed to the exhaust gas stream, it needs to be properly cooled down during operation. Thanks to the above-mentioned aspect of the present disclosure, the DEF injector can be effectively cooled down by the coolant circulating in the "low-temperature" cooling system, thereby improving packaging and reducing costs. At the same time, the heat received from the DEF injector, has the effect of increasing the temperature of the coolant entering the LR-EGR cooler, thereby contributing to prevent the condensation phenomena in the recirculated exhaust gasses.

According to another aspect of the present disclosure, the cooling system may include an electronic control unit configured to control a coolant temperature at a coolant inlet of the long-route exhaust-gas-recirculation cooler by regulating a mass flow rate of the coolant circulating in the coolant circuit. In this way, it is possible to properly regulate the coolant temperature entering the LR-EGR cooler to cope with various operating conditions. This aspect of the present disclosure is feasible because the power balance across the WCAC is expressed by the following equation:

$$\dot{m}_{H_2O} \cdot c_{p,H_2O} \cdot \Delta T_{H_2O} = \dot{m}_{air} \cdot c_{p,air} \cdot \Delta T_{air}$$

wherein:

- $\dot{m}_{H_2O}$ is the mass flow rate of coolant in the low-temperature coolant circuit (through the WCAC and the LR-EGR cooler);
- $c_{p,H_2O}$ is the heat capacity of the coolant,
- $\Delta T_{H_2O}$ is the difference between the temperature of the coolant at the coolant outlet of the WCAC and the temperature of the coolant at the coolant inlet of the WCAC, $\dot{m}_{air}$ is the mass flow rate of the charged air through the WCAC,
- $c_{p,air}$ is the heat capacity of the charged air, and
- $\Delta T_{air}$ is the difference between the temperature of the charged air at the air inlet of the WCAC and the temperature of the charged air at the air outlet of the WCAC.

As a consequence, the following relations apply:

$$\Delta T_{H_2O} = \frac{\dot{m}_{air}}{\dot{m}_{H_2O}} \cdot \frac{c_{p,air}}{c_{p,H_2O}} \cdot \Delta T_{air}$$

and, since the heat capacities are constants, $$\Delta T_{H_2O} \propto \frac{\dot{m}_{air}}{\dot{m}_{H_2O}} \cdot \Delta T_{air}.$$

As a matter of fact, a proportional relationship exists between $\Delta T_{H_2O}$ and the coolant mass flow rate $\dot{m}_{H_2O}$. Hence, varying the coolant mass flow rate $\dot{m}_{H_2O}$ is actually possible to regulate the coolant temperature at the coolant outlet of the WCAC and thus the coolant temperature at the coolant inlet of the LR-EGR cooler. The equations above also demonstrate that, by properly adjusting the coolant mass flow rate $\dot{m}_{H_2O}$ basing on the charged-air mass flow rate $\dot{m}_{air}$, it is theoretically possible to keep $\Delta T_{H_2O}$ almost independent from $\Delta T_{air}$.

According to an aspect of the present disclosure, the electronic control unit may be configured to control the coolant temperature at the coolant inlet of the long-route exhaust-gas-recirculation cooler to be higher than a predetermined threshold value thereof. This aspect of the present disclosure has the effect of guaranteeing a proper coolant temperature under every operating condition. By way of example, the coolant temperature threshold value may be included between 45° C. and 55° C. This temperature level has the effect of preventing the condensation phenomena in the recirculated exhaust gas stream, because the coolant temperature is regulated as being higher than the dew point of the exhaust gases present in the EGR circuit.

According to an aspect of the present disclosure, the electronic control unit may be configured to measure the coolant temperature at the coolant inlet of the long-route exhaust-gas-recirculation cooler, calculate an error between the measured value of the coolant temperature and a predetermined target value thereof; and use the calculated error as input of a controller configured to regulate the coolant mass flow rate to minimize the calculated error. This feedback control loop has the effect of realizing a very reliable control of the coolant temperature entering the LR-EGR cooler.

According to another aspect of the present disclosure, the electronic control unit may be configured to: determine a coolant temperature at a coolant inlet of the charged-air cooler, determine a mass flow rate of air through the charged-air cooler; determine an air temperature difference between an air inlet and an air outlet of the charged-air cooler; calculate a desired value of the coolant mass flow rate on the basis of the coolant temperature at the coolant inlet of the charged-air cooler, of the air mass flow rate, of the air temperature difference, and of a target value of the coolant temperature at the inlet of the long-route exhaust-gas-recirculation cooler; and regulate the coolant mass flow rate according to the desired value. This feed-forward control loop may be used to regulate faster the coolant temperature entering LR-EGR cooler during particular operating conditions and/or to regulate the coolant temperature entering LR-EGR cooler without the need of a temperature sensor at the LR-EGR cooler inlet.

According to an aspect of the present disclosure, the electronic control unit may be configured to regulate the coolant mass flow rate by varying a speed of the coolant pump. This aspect of the present disclosure provides a simple and quite effective solution to adjust the coolant mass flow rate.

Another embodiment of the present disclosure provides a method of operating a cooling system for an internal combustion engine, wherein the cooling system includes a coolant pump for circulating a coolant in a coolant circuit, a radiator disposed in the coolant circuit, a charged-air cooler disposed in the coolant circuit downstream of the radiator, and a long-route exhaust-gas-recirculation cooler disposed in the coolant circuit downstream of the charged-air cooler and upstream of the radiator, and wherein the operating method includes the step of controlling a coolant temperature at a coolant inlet of the long-route exhaust-gas-recirculation cooler by regulating a mass flow rate of the coolant circulating in the coolant circuit. This embodiment of the present disclosure has basically the same effects explained above with regard to the electronic control unit, in particular that of allowing a proper regulation of the coolant temperature entering the LR-EGR cooler.

According to an aspect of this second embodiment of the present disclosure, the cooling system may further includes a cooler for a diesel-exhaust-fluid (DEF) injector disposed in the coolant circuit downstream of the charged-air cooler and upstream of the long-route exhaust-gas-recirculation cooler. Thanks to this aspect of the present disclosure, the DEF injector is effectively cooled by the same coolant circulating in the "low-temperature" cooling system, thereby improving packaging and reducing the costs. At the same time, the heat received from the DEF injector, increases the temperature of the coolant entering the LR-EGR cooler, thereby contributing to prevent the condensation phenomena of the water contained in the recirculated exhaust gas stream.

According to another aspect of the second embodiment of the present disclosure, the operating method may provide that the coolant temperature at the coolant inlet of the long-route exhaust-gas-recirculation cooler is controlled to be higher than a predetermined threshold value thereof. This aspect of the present disclosure has the effect of guaranteeing a proper coolant temperature under every operating condition. By way of example, the coolant temperature threshold value may be included between 45° C. and 55° C. This temperature level has the effect of preventing the condensation phenomena in the recirculated exhaust gas stream, because the coolant temperature is regulated as being higher than the water dew point.

According to an aspect of the second embodiment of the present disclosure, the operating method includes measuring the coolant temperature at the coolant inlet of the long-route exhaust-gas-recirculation cooler, calculating an error between the measured value of the coolant temperature and a predetermined target value thereof; and using the calculated error as input of a controller configured to regulate the coolant mass flow rate to minimize the calculated error. This feedback control loop has the effect of realizing a very reliable control of the coolant temperature entering the LR-EGR cooler.

According to another aspect of the second embodiment of the present disclosure, the operating method may include determining a coolant temperature at the coolant inlet of the charged-air cooler; determining a mass flow rate of air through the charged-air cooler, determining an air temperature difference between an air inlet and an air outlet of the charged-air cooler; calculating a desired value of the coolant mass flow rate on the basis of the coolant temperature at the coolant inlet of the charged-air cooler, of the air mass flow rate, of the air temperature difference, and of a target value of the coolant temperature at the inlet of the long-route exhaust-gas-recirculation cooler; and regulating the coolant mass flow rate according to the desired value. This feed-forward control loop may be used to regulate faster the coolant temperature entering LR-EGR cooler during certain operating conditions and/or to regulate the coolant temperature entering LR-EGR cooler without the need of a temperature sensor at the LR-EGR cooler inlet.

According to another aspect of the second embodiment of the present disclosure, the operating method may provide for regulating the coolant mass flow rate by varying a speed of the coolant pump. This aspect of the present disclosure provides a simple and quite effective solution to adjust the coolant mass flow rate.

The method of the present disclosure can be carried out with the help of a computer program including a program-code for carrying out the method described above, and in the form of a computer program product including the computer program. The method can be also embodied as an electromagnetic signal, the signal being modulated to carry a sequence of data bits which represent a computer program to carry out the method.

BRIEF DESCRIPTION OF THE DRAWINGS

The resent present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
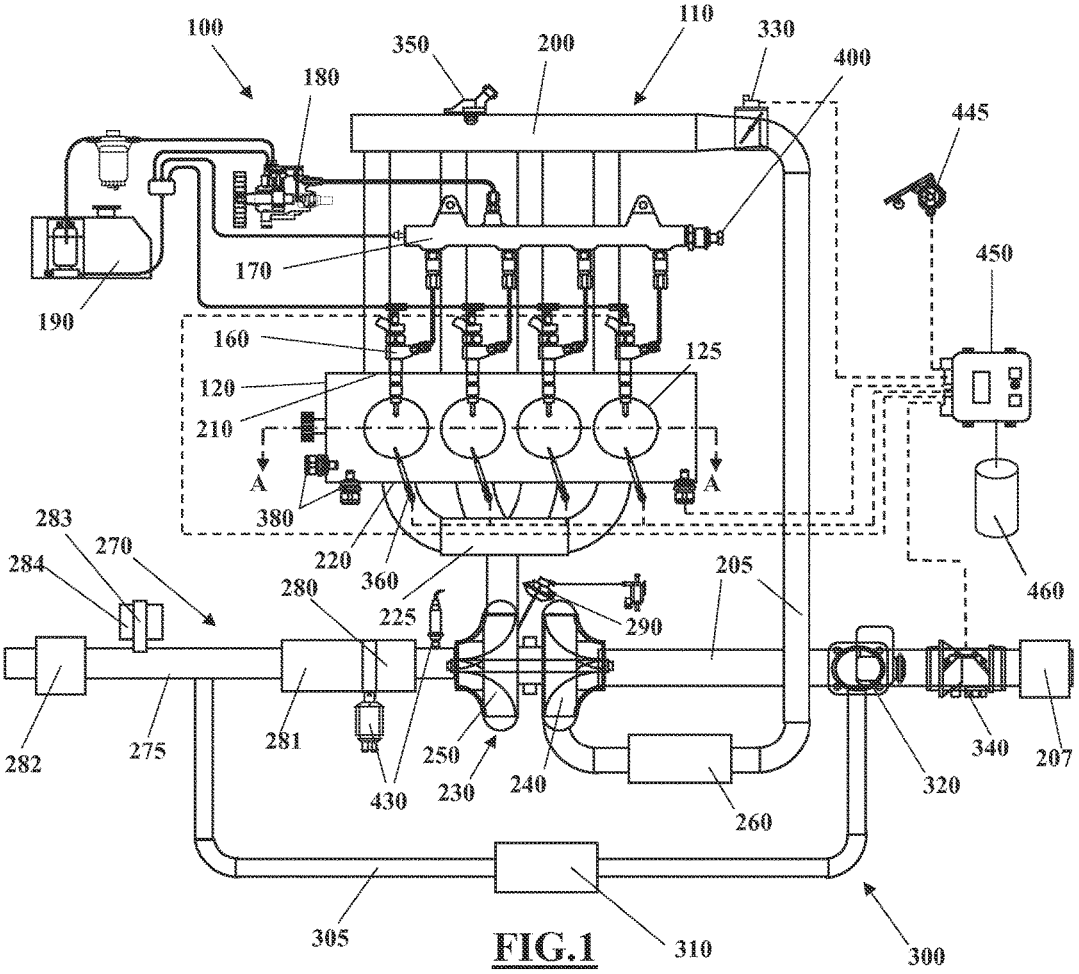
FIG. 1 schematically shows an automotive system according to an embodiment of the present disclosure.
Figure 2:
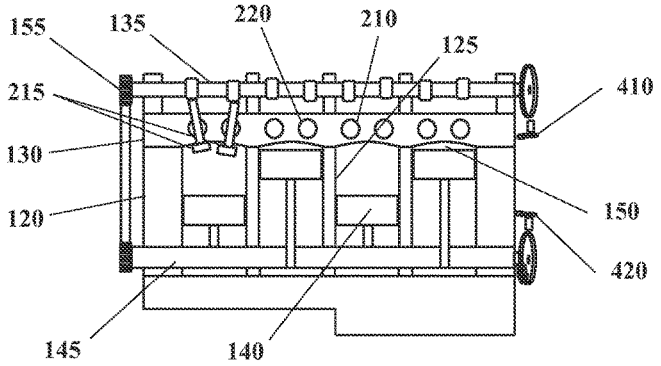
FIG. 2 is the section A-A of an internal combustion engine belonging to the automotive system of FIG. 1.

Some embodiments may include an automotive system 100, as shown in FIGS. 1 and 2, which includes an internal combustion engine 110, for example a Diesel engine of a motor vehicle. The internal combustion engine 110 has an engine block 120 defining at least one cylinder 125 having a piston 140 coupled to rotate a crankshaft 145. A cylinder head 130 cooperates with the piston 140 to define a combustion chamber 150. A fuel and air mixture (not shown) is cyclically disposed in the combustion chamber 150 and ignited, resulting in hot expanding exhaust gasses causing reciprocal movement of the piston 140 and thus rotation of the crankshaft 145.

The fuel is provided by at least one fuel injector 160 and the air through at least one intake port 210. The fuel is provided at high pressure to the fuel injector 160 from a fuel rail 170 in fluid communication with a high pressure fuel pump 180 that increase the pressure of the fuel received from a fuel source 190. Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The internal combustion engine 110 may be equipped with an air intake pipe 205 that provides air from the ambient environment to an intake manifold 200, which distributes the incoming air to the engine cylinders 125 through the air intake port(s) 210. An air filter 207 may be located in the intake pipe 205, in order to remove solid particulates such as dust, pollen, and other particles from the air. In some embodiments, a throttle body 330 may be provided to regulate the flow of air into the manifold 200. A forced air system such as a turbocharger 230, having a compressor 240 rotationally coupled to a turbine 250, may be provided. Rotation of the compressor 240 increases the pressure and temperature of the air in the intake pipe 205 and manifold 200. The turbine 250 rotates by receiving exhaust gases from an exhaust manifold 225 that directs exhaust gases from the exhaust ports 220 and through a series of vanes prior to expansion through the turbine 250. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate. A water-cooled charged-air cooler (WCAC) 260 disposed in the intake pipe 205 downstream of the compressor 240 may reduce the temperature of the air, before it reaches the intake manifold 200.

The exhaust gases exit the turbine 250 and are directed into an exhaust system 270. The exhaust system 270 may include an exhaust pipe 275 having one or more exhaust aftertreatment devices. The aftertreatment devices may be any device configured to change the composition of the exhaust gases. By way of example, the aftertreatment devices may include a diesel oxidation catalyst (DOC) 280 for degrading residual hydrocarbons (HC) and carbon oxides (CO) contained in the exhaust gasses, and a diesel particulate filter (DPF) 281 for capturing and removing diesel particulate matter (soot) from the exhaust gasses. The aftertreatment device may further include a selective catalytic reduction (SCR) systems, which includes a SCR catalyst 282 disposed in the exhaust pipe 275 downstream of the particulate filter 281, and a diesel-exhaust-fluid (DEF) injector 283 disposed the exhaust pipe 275 between the particulate filter 281 and the SCR catalyst 282. The DEF injector 283 is provided for injecting into the exhaust pipe 275 a diesel exhaust fluid (DEF), for example urea, which mixes with the exhaust gases and is converted thereby into a gaseous reducing agent (e.g. ammonia). This gaseous reducing agent is absorbed inside the SCR catalyst 282, thereby prompting the reduction of the nitrogen oxides ($NO_x$) contained in the exhaust gases into diatonic nitrogen ($N_2$) and water ($H_2O$). Since the DEF injector 283 is exposed to the exhaust gas stream, it may be arranged in thermal exchange relation with a dedicated cooler 284 provided for reducing its temperature.

In order to further reduce the nitrogen oxides ($NO_x$) emissions, the automotive system 100 may include an exhaust gas recirculation (EGR) system 300, in this example a "long-route" (LR) EGR system, which is provided for recirculating a portion of the exhaust gasses from the exhaust system back into the into the intake system and thus into the engine cylinders 125. The LR-EGR system 300 may include an LR-EGR conduit 305, which fluidly connects the exhaust pipe 275 to the intake pipe 205, and a LR-EGR cooler 310 located in the LR-EGR conduit 305 to reduce the temperature of the recirculated exhaust gases before they reach the intake pipe 205. More specifically, the LR-EGR conduit 305 branches from a portion of the exhaust pipe 275 located downstream of the turbine 250, in the example downstream of the DPF 281 and upstream of the DEF injector 283, to meet a portion of the intake pipe 205 located between the air filter 207 and the compressor 240. A LR-EGR valve 320, which may be located at the junction between the LR-EGR conduit 305 and the intake pipe 205, may regulate the flow rate of exhaust gases in the LR-EGR system 300.

Figure 3:
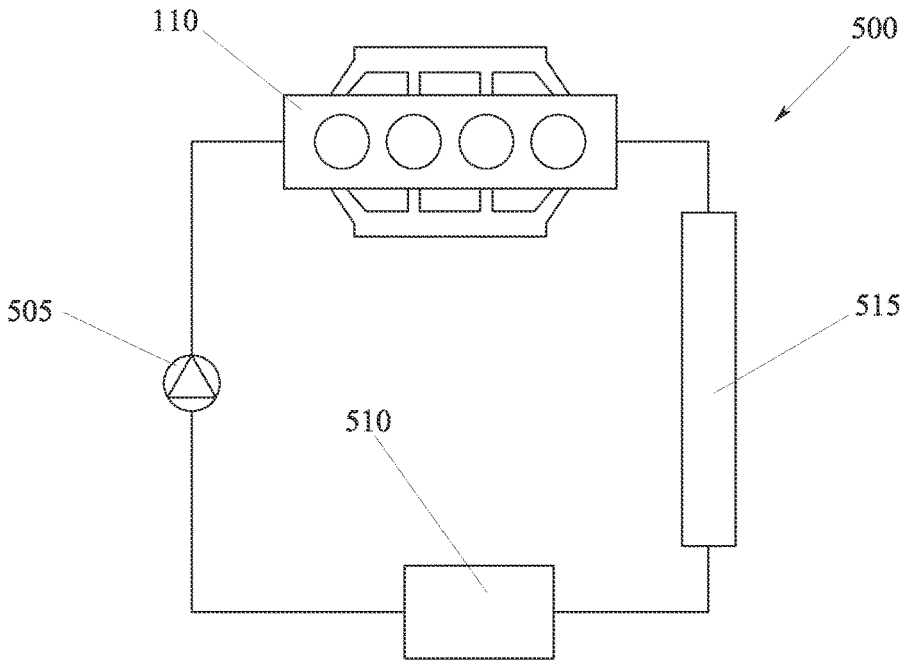
FIG. 3 schematically shows a "high-temperature" cooling system belonging to the automotive system of FIG. 1.

Under operation, the internal combustion engine 110 is cooled by a "high-temperature" cooling system 500, as schematically represented in FIG. 3, which includes a coolant pump 505 that draws a coolant, typically a mixture of water and antifreeze, from a coolant tank 510 and circulates that coolant through a plurality of cooling channels internally realized in the engine block 120 and the cylinder head 130. The coolant exits these channels and is directed towards a "high-temperature" radiator 515, where the coolant exchanges the heat received from the engine 110 to the air of the ambient environment, before returning to the coolant pump 505.

Figure 4:
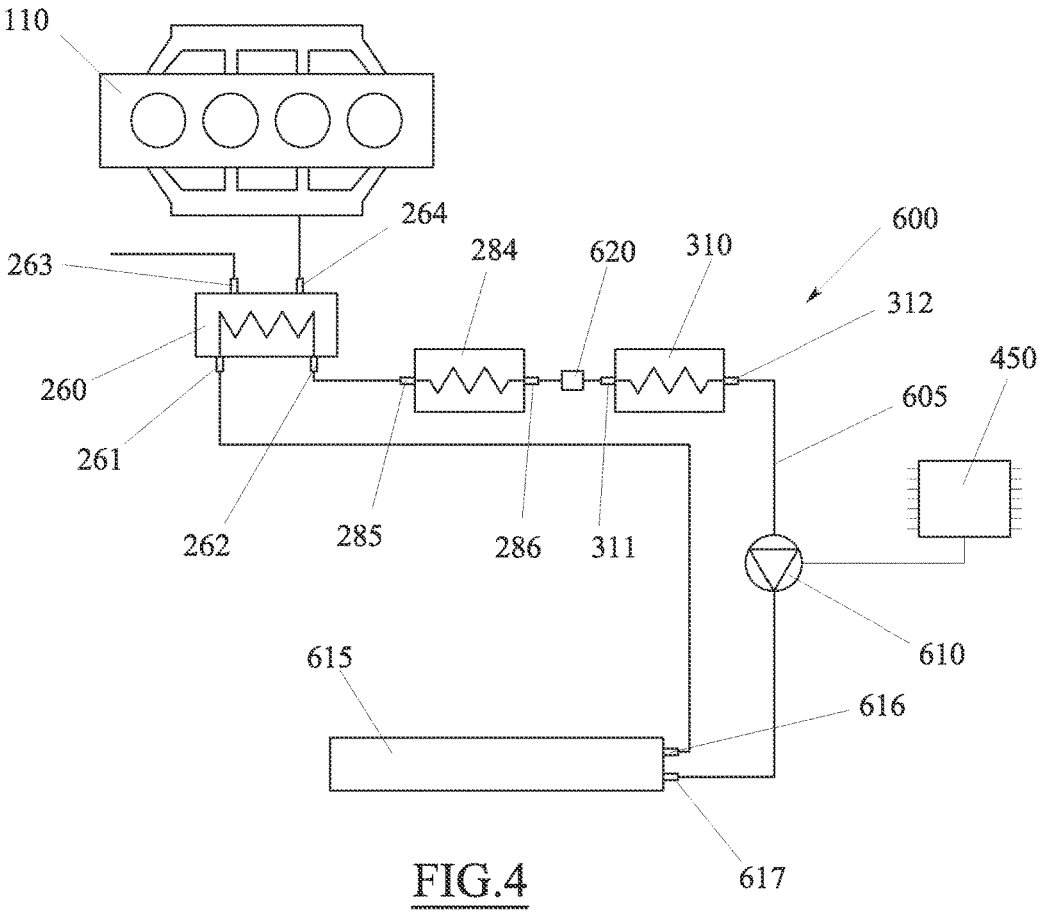
FIG. 4 schematically shows a "low-temperature" cooling system belonging to the automotive system of FIG. 1.

The internal combustion engine 110 may further include a "low-temperature" cooling system 600, as schematically shown in FIG. 4, which may be separated and independent from the "high-temperature" cooling system 500 described above. The cooling system 600 includes a coolant circuit 605 and a coolant pump 610 provided for circulating a coolant, typically a mixture of water and antifreeze, in the coolant circuit 605. The pump 610 may be a rotodynamic pump, such as a centrifugal pump, actuated by a dedicated electric motor whose rotational speed may be regulated, for example by means of a pulse width modulation (PWM) signal. The cooling system 600 further includes a "low-temperature" radiator 615 disposed in the coolant circuit 605, and the WCAC 260 disposed in the coolant circuit 605 downstream of the radiator 615, with respect to the direction of the coolant imparted by the pump 610. In other words, the WCAC 260 has a coolant inlet 261 hydraulically connected with a coolant outlet 616 of the radiator 615, and a coolant outlet 262 hydraulically connected back with a coolant inlet 617 of the radiator 615. In this way, the coolant is first heated in the WCAC 260 by the charged air directed to the intake manifold 200 (which is correspondently cooled down), and then is cooled down in the "low-temperature" radiator 615 by the air of the ambient environment, before returning to the WCAC 260.

The cooling system 600 may further include the LR-EGR cooler 310, which is disposed in the coolant circuit 605 downstream of the WCAC 260 and upstream of the radiator 615, with respect to the direction of the coolant imparted by the pump 610. In other words, the LR-EGR cooler 310 has a coolant inlet 311 hydraulically connected with the coolant outlet 262 of the WCAC 260, and a coolant outlet 312 hydraulically connected with the coolant inlet 617 of the radiator 615. In this way, before reaching the radiator 615, the coolant exiting from the WCAC 260 is forced to pass through the LR-EGR cooler 310, where it is used to cool down the recirculated exhaust gasses flowing in the LR-EGR conduit 305. Since the coolant temperature in the "low-temperature" cooling system 600 is generally lower than the coolant temperature in the "high-temperature" cooling system 500, the LR-EGR cooler 310 may be smaller than conventional LR-EGR coolers, with the effect of improving packaging and reducing the costs. At the same time, passing through the WCAC 260, the temperature of the coolant entering the LR-EGR cooler 310 can be high enough to prevent condensation phenomena in the recirculated exhaust gas stream.

In this example, the cooling system 600 includes also the cooler 284 of the DEF injector 283, which may be disposed in the coolant circuit 605 downstream of the WCAC 260 and upstream of the LR-EGR cooler 310, with respect to the direction of the coolant imparted by the pump 610. In other words, the cooler 284 has a coolant inlet 285 hydraulically connected with the coolant outlet 262 of the WCAC 260, and a coolant outlet 286 hydraulically connected with the coolant inlet 311 of the LR-EGR cooler 310. In this way, before entering the LR-EGR cooler 310, the coolant exiting from the WCAC 260 is forced to pass through the cooler 284, where it is used to cool down the DEF injector 283. At the same time, the heat received from the DEF injector 283, has the effect of further increasing the temperature of the coolant entering the LR-EGR cooler 310, thereby further contributing to prevent the condensation phenomena in the recirculated exhaust gas stream.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor, an accelerator pedal position sensor 445, and a coolant temperature sensor 620 located at the coolant inlet 311 of the LR-EGR cooler 310. Furthermore, the ECU 450 may generate output signals to various control devices that are arranged to control the operation of the ICE 110, including, but not limited to, the fuel injectors 160, the throttle body 330, the EGR Valve 320, the VGT actuator 290, the cam phaser 155 and the coolant pump 610. Note, dashed lines are used to indicate communication between the ECU 450 and the various sensors and devices, but some are omitted for clarity.

Turning now to the ECU 450, this apparatus may include a digital central processing unit (CPU) in communication with a memory system and an interface bus. The CPU is configured to execute instructions stored as a program in the memory system 460, and send and receive signals to/from the interface bus. The memory system 460 may include various storage types including optical storage, magnetic storage, solid state storage, and other non-volatile memory. The interface bus may be configured to send, receive, and modulate analog and/or digital signals to/from the various sensors and control devices. The program may embody the methods disclosed herein, allowing the CPU to carryout out the steps of such methods and control the ICE 110.

The program stored in the memory system 460 is transmitted from outside via a cable or in a wireless fashion. Outside the automotive system 100 it is normally visible as a computer program product, which is also called computer readable medium or machine readable medium in the art, and which should be understood to be a computer program code residing on a carrier, said carrier being transitory or non-transitory in nature with the consequence that the computer program product can be regarded to be transitory or non-transitory in nature.

An example of a transitory computer program product is a signal, e.g. an electromagnetic signal such as an optical signal, which is a transitory carrier for the computer program code. Carrying such computer program code can be achieved by modulating the signal by a conventional modulation technique such as QPSK for digital data, such that binary data representing said computer program code is impressed on the transitory electromagnetic signal. Such signals are e.g. made use of when transmitting computer program code in a wireless fashion via a WiFi connection to a laptop.

In case of a non-transitory computer program product the computer program code is embodied in a tangible storage medium. The storage medium is then the non-transitory carrier mentioned above, such that the computer program code is permanently or non-permanently stored in a retrievable way in or on this storage medium. The storage medium can be of conventional type known in computer technology such as a flash memory, an Asic, a CD or the like.

Instead of an ECU 450, the automotive system 100 may have a different type of processor to provide the electronic logic, e.g. an embedded controller, an onboard computer, or any processing module that might be deployed in the vehicle.

According to some embodiments, the ECU 450 may be configured to control the temperature of the coolant at the coolant inlet 311 of the LR-EGR cooler 310 by adjusting the mass flow rate of the coolant that circulates in the coolant circuit 605 of the "low-temperature" cooling system 600. More specifically, the ECU 450 may control the coolant temperature at the coolant inlet 311 of the LR-EGR cooler 310 to be higher than a predetermined threshold value thereof, thereby guaranteeing a proper coolant temperature under every operating condition. By way of example, the coolant temperature threshold value may be included between 45° C. and 55° C. (i.e. higher than the water dew point), in order to guarantee the prevention of the condensation phenomena in the recirculated exhaust gas stream.

Figure 5:
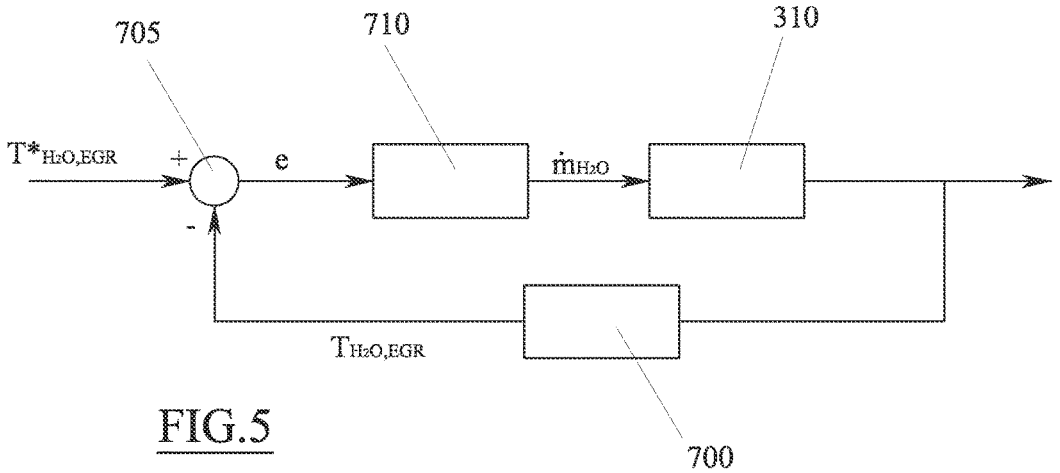
FIG. 5 is a flow chart illustrating a feedback control strategy for the "low-temperature" cooling system of FIG. 4.

To perform this function, the ECU 450 may implement a feedback control loop, as shown in FIG. 5. At block 700 the coolant temperature $T_{H_2O,EGR}$ is measured at the coolant inlet 311 of the LR-EGR cooler 310. At block 705, an error e between the measured value $T_{H_2O,EGR}$ of the coolant temperature and a predetermined target value $T^*_{H_2O,EGR}$ is calculated. A controller 710, such as a PI or a PID controller, which is configured to regulate the coolant mass flow rate $\dot{m}_{H_2O}$, uses the calculated error e as input to minimize the calculated error. In this context, the coolant temperature at the coolant inlet 311 may be measured with the temperature sensor 620. The target value $T^*_{H_2O,EGR}$ may be set to be equal or higher than the threshold value described above and memorized in the memory system 460. The coolant mass flow rate $\dot{m}_{H_2O}$ may be regulated by adjusting the rotational speed of the coolant pump 610.

Figure 6:
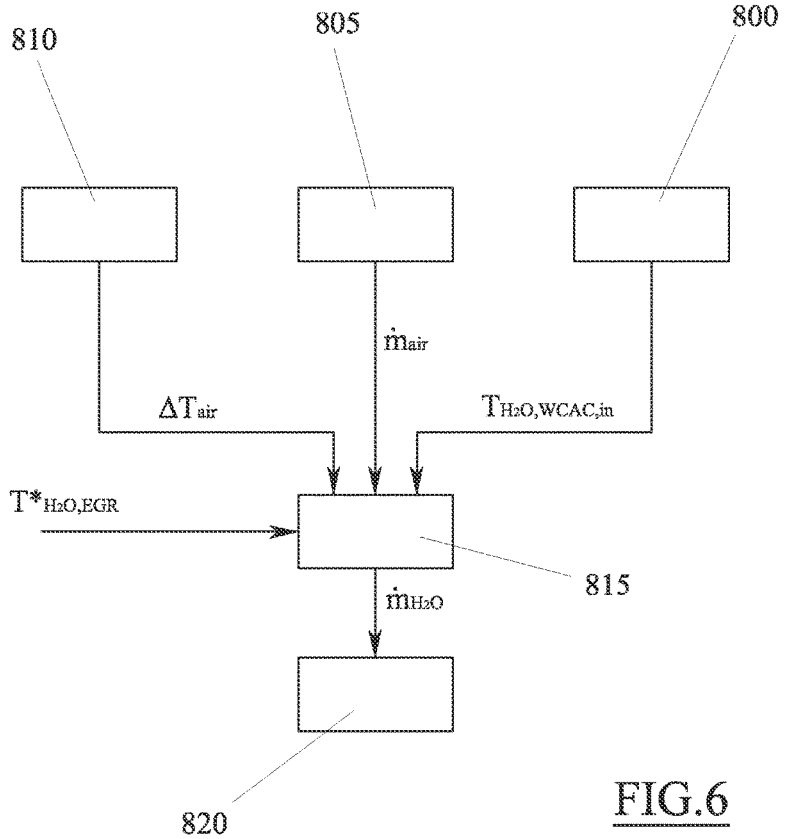
FIG. 6 is a flow chart illustrating a feed-forward control strategy for the "low-temperature" cooling system of FIG. 4.

Alternatively, the ECU 450 may implement a feed-forward control strategy, as shown in FIG. 6. At block 800, the coolant temperature $T_{H_2O,WCAC,in}$ at the coolant inlet 261 of the WCAC 260 is determined. At block 805, a mass flow rate $\dot{m}_{air}$ of air through the WCAC 260 is determined. At block 810, an air temperature difference $\Delta T_{air}$ between an air inlet 263 and an air outlet 264 of the WCAC 260 is determined. At block 815, a desired value $\dot{m}_{H_2O}$ of the coolant mass flow rate is calculated on the basis of the coolant temperature $T_{H_2O,WCAC,in}$ at the coolant inlet 261 of the WCAC 260, of the air mass flow rate $\dot{m}_{air}$, of the air temperature difference $\Delta T_{air}$, and of a target value $T^*_{H_2O,EGR}$ of the coolant temperature at the inlet 311 of the LR-EGR cooler 310. At block 820, the coolant mass flow rate is regulated according to the desired value $\dot{m}_{H_2O}$.

In greater details, the target value $T^*_{H_2O,EGR}$ of the coolant temperature at the inlet 261 of the WCAC 260 may be used in the block 815 to determine a target value $T^*_{H_2O,WCAC,out}$ of the coolant temperature at the coolant outlet 262 of the WCAC 260 and then to calculate a target value $\Delta T^*_{H_2O}$ of the coolant temperature difference between the coolant outlet 262 and the coolant inlet 261 of the WCAC 260:

$$\Delta T^*_{H_2O}=T^*_{H_2O,WCAC,out}-T_{H_2O,WCAC,in}.$$

The desired coolant temperature difference $\Delta T^*_{H_2O}$ can finally be used (always in the block 815) to calculate the desired value $\dot{m}_{H_2O}$ of the coolant mass flow rate, using the power balance across the WCAC 260:

$$\dot{m}_{H_2O} = \frac{\dot{m}_{air}}{\Delta T_{H_2O}} \cdot \frac{c_{p,air}}{c_{p,H_2O}} \cdot \Delta T_{air}$$

wherein:

$c_{p,H_2O}$ is the heat capacity of the coolant; and $c_{p,air}$ is the heat capacity of the charged air.

In this context, the coolant temperature $T_{H_2O,WCAC,in}$ at the coolant inlet 261 of the WCAC 260 may be measured or estimated on the basis of the air temperature in the ambient environment and the efficiency of the radiator 615. The mass flow rate $\dot{m}_{air}$ of air through the WCAC 260 may be calculated on the basis of the air flow rate measured by the sensor 340 and an estimation of the recirculated exhaust gas flow rate. The temperature difference $\Delta T_{air}$ between the air inlet 263 and the air outlet 264 of the WCAC 260 may be measured with the aid of at least an air temperature sensor located in the intake pipe 205 upstream of the WCAC 260. The target value $T^*_{H_2O,EGR}$ of the coolant temperature at the inlet of the WCAC 260 may be set to be equal or higher than the threshold value explained above and memorized in the memory system 460. The target value $T^*_{H_2O,WCAC,out}$ of the coolant temperature at the coolant outlet 262 of the WCAC 260 may be calculating on the basis of the target value $T^*_{H_2O,EGR}$, taking into account the power balance of the DEF injector cooler 284 (if present). The coolant mass flow rate $\dot{m}_{H_2O}$ may be regulated by adjusting the rotational speed of the coolant pump 610.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the present disclosure as set forth in the appended claims and their legal equivalents.

What is claimed is:

1. A cooling system for an internal combustion engine comprising:

a coolant pump for circulating a coolant in a coolant circuit;

a radiator disposed in the coolant circuit;

a charged-air cooler disposed in the coolant circuit downstream of the radiator;

a long-route exhaust-gas-recirculation cooler disposed in the coolant circuit downstream of the charged-air cooler and upstream of the radiator; and an electronic control unit configured to control a coolant temperature at a coolant inlet of the long-route exhaust-gas-recirculation cooler by regulating a mass flow rate of the coolant circulating in the coolant circuit, wherein the electronic control unit is configured to:

determine a coolant temperature at a coolant inlet of the charged-air cooler;

determine a mass flow rate of air through the charged-air cooler;

determine an air temperature difference between an air inlet and an air outlet of the charged-air cooler;

calculate a desired value of the coolant mass flow rate on the basis of the coolant temperature at the coolant inlet of the charged-air cooler, of the air mass flow rate, of the air temperature difference, and of a target value of the coolant temperature at the inlet of the long-route exhaust-gas-recirculation cooler; and regulate the coolant mass flow rate according to the desired value.

2. The cooling system according to claim 1, further comprising a cooler for a diesel-exhaust-fluid injector disposed in the coolant circuit downstream of the charged-air cooler and upstream of the long-route exhaust-gas-recirculation cooler.

3. The cooling system according to claim 1, wherein the electronic control unit is configured to control the coolant temperature at the coolant inlet of the long-route exhaust-gas-recirculation cooler to be higher than a predetermined threshold value thereof.

4. The cooling system according to claim 3, wherein the coolant temperature threshold value is comprised between 45° C. and 55° C.

5. The cooling system according to claim 1, wherein the electronic control unit is configured to regulate the coolant mass flow rate by varying a speed of the coolant pump.

6. A method of operating a cooling system for an internal combustion engine comprises:

circulating a coolant with a coolant pump in a coolant circuit having a radiator, a charged-air cooler disposed in the coolant circuit downstream of the radiator, and a long-route exhaust-gas-recirculation cooler disposed in the coolant circuit downstream of the charged-air cooler and upstream of the radiator; and controlling a coolant temperature at a coolant inlet of the long-route exhaust-gas-recirculation cooler by regulating a mass flow rate of the coolant circulating in the coolant circuit, wherein the regulating the mass flow rate comprises:

determining a coolant temperature at a coolant inlet of the charged-air cooler;

determining a mass flow rate of air through the charged-air cooler;

determining an air temperature difference between an air inlet and an air outlet of the charged-air cooler;

calculating a desired value of the coolant mass flow rate on the basis of the coolant temperature at the coolant inlet of the charged-air cooler, of the air mass flow rate, of the air temperature difference, and of a target value of the coolant temperature at the inlet of the long-route exhaust-gas-recirculation cooler; and regulating the coolant mass flow rate according to the desired value.

7. A computer program comprising a computer code suitable for performing the method according to claim 6 stored on a non-transitory computer readable medium.

8. A computer program product comprising a computer which when programmed with the computer code of claim 7 operating a cooling system for an internal combustion engine.

* * * * *